United States Patent [19]

Drlik

[11] 4,185,778

[45] Jan. 29, 1980

[54] SPRAY NOZZLE

[75] Inventor: Romuald J. Drlik, Phoenix, Ariz.

[73] Assignee: Envirotech Corporation, Menlo Park, Calif.

[21] Appl. No.: 891,615

[22] Filed: Mar. 30, 1978

[51] Int. Cl.[2] ..... B05B 1/34

[52] U.S. Cl. ..... 239/405; 239/434.5

[58] Field of Search ..... 239/405, 406, 433, 434.5, 239/489; 417/194

[56] References Cited

U.S. PATENT DOCUMENTS

| | | | |
|---|---|---|---|
| 1,469,479 | 10/1923 | Kent | 239/405 |
| 2,072,281 | 3/1937 | Simonin | 239/405 X |
| 3,474,970 | 10/1969 | Simmons et al. | 239/406 X |
| 3,923,247 | 12/1975 | White | 239/14 |

*Primary Examiner*—John J. Love

*Attorney, Agent, or Firm*—Michael J. Pollock; Robert E. Krebs

[57] ABSTRACT

A spray nozzle which transforms a stream of water into a thin-walled tubular sheet which is atomized over a hydrostep. The nozzle comprises a body, the main portion of which has a cylindrical contour and a central passage of venturi shape, with the passage being of cloverleaf formation in horizontal cross-section, presenting a plurality of helical recesses which open onto the venturi passage. The lower end of the latter is generally bell-shaped and formed with a cylindrical hydrostep. A conduit for air under pressure enters the venturi passage from the upper end of the body and has a discharge end at the axis of the venturi passage and slightly above its waist.

6 Claims, 4 Drawing Figures

SPRAY NOZZLE

The present invention relates to spray nozzles and is concerned primarily with a spray nozzle which transforms a stream of water into a thin-walled tubular sheet which is broken up into fine droplets as it passes over a hydro-step.

BACKGROUND OF THE INVENTION

A patentability search was conducted prior to the preparation of this application and this search brings to light the following patents as those found coming closest to the present subject:

| | | | |
|---|---|---|---|
| 1,493,584 | Wills | 3,692,244 | Lincoln |
| 2,259,215 | Scheurer | 3,942,724 | Mocarski |
| 2,820,418 | Sullivan et al. | 3,515,354 | Presson |
| 1,469,479 | Kent | 3,575,352 | Hall |
| 298,449 | McOvat | 3,471,091 | Baker |

A brief comment is made on the more pertinent of these references as follows:

Sullivan et al.

This patent discloses a jet assembly for pumps comprising a nozzle and venturi. The nozzle is shown at 36 and the venturi at 12. This patent is clearly lacking in the cloverleaf passage through the throat of the venturi and which has lateral extensions or recesses which are helical, as in the present invention. It is also lacking in the hydro-step which results in the mist being formed into fine droplets.

Presson

This patent is to a spray nozzle used in applying wall texturing materials to wall structures. This is a far cry from generating a fine mist and the device illustrated clearly does not have the cloverleaf passages with the helical lateral extensions or recesses or hydro-step of the subject spray nozzle.

Scheurer

This patent is to a spray gun for applying heavy liquid material such as emulsified asphalt loaded with cork to the walls of a structure. Here again, it is noted that the intended use of the spray gun is far removed from that of the instant spray nozzle and, in addition to lacking the features discussed above, fails to disclose a complete venturi.

Wills

This reference is to an oil burner and is cited because of the disclosure in FIG. 4 of the spiral grooves 18. However, they are not included in the throat of a venturi if indeed a venturi is disclosed.

Kent

This is another example of a burner and is cited because it discloses the spiral grooves 19 in the inner surface of the inlet of a venturi. However, it is also lacking in the cloverleaf passage and hydro-step of the subject now under consideration.

No comment is made on the remaining patents other than to point out that they are cited to complete the picture of the art of spray nozzles and devices generally similar thereto.

The prior art as exemplified by the above patents is noticeably lacking in a spray nozzle comprising a body that has a generally cylindrical contour and is formed with an axial venturi passage including an upper flared portion, an intermediate throat or waist, and a lower bell-shaped portion. The venturi passage is cloverleaf in horizontal cross-section and has helical lateral recesses or extensions. The bell-shaped lower portion is formed with a hydro-step over which the thin-walled tubular sheet of water passes to be broken up into a mist or fine droplets. A stream of water is introduced into the upper flared portion and a conduit for air under pressure has a portion adjacent to its discharge end coaxial with the venturi passage.

OBJECTS OF THE INVENTION

With the foregoing conditions in mind, the present invention has in view the following objectives:

1. To provide a spray nozzle comprising a body formed with a central venturi passage including an upper flared portion into which a stream of liquid such as water is introduced, a throat or waist, and a lower bell-shaped portion formed with a hydro-step;

2. To provide, in a spray nozzle of the type noted, a venturi passage which is cloverleaf in shape in horizontal cross-section and has helical lateral recesses or extensions;

3. To provide, in a spray nozzle of the character aforesaid, a conduit for delivering air under pressure axially to the venturi passage in close proximity to and above the waist of the venturi passage;

4. To provide, in a spray nozzle of the kind described, a conduit for air under pressure having a portion immediately adjacent to its discharge end which is coaxial with said venturi passage; and 5. To provide in a spray nozzle of the type noted a hydro-step that is defined by an annular flat surface normal to the axis of the venturi passage and an inner cylindrical surface parallel to the axis of the venturi passage.

Various other more detailed objects and advantages of the invention such as arise in connection with carrying out the above-noted ideas in a practical embodiment will in part become apparent and in part be hereinafter stated as the description of the invention proceeds.

SUMMARY OF THE INVENTION

The foregoing objects are achieved by providing a spray nozzle including a body having a cylindrical contour and a venturi passage coaxial with the cylindrical surface defining said contour. The venturi passage has an upper flared portion into which a stream of liquid such as water is introduced, an intermediate waist or throat, and a lower bell-shaped portion formed with a hydro-step. The latter is defined by an annular flat surface normal to the axis of the venturi passage, with an inwardly facing cylindrical surface at the periphery of the annular flat surface.

The venturi passage is cloverleaf in shape in horizontal cross-section, with the cloverleaf being defined by a plurality of helical lateral recesses or extensions.

A conduit for air under pressure has a discharge end in close proximity to and above the waist of the venturi passage. That portion of the conduit immediately adjacent said discharge end is coaxial with the axis of the venturi passage.

In operation, water in the stream entering the venturi passage at its upper end is transformed into a thin-walled tubular sheet by the air under pressure which is injected thereinto at the center thereof and also by the swirling action imparted thereto by the helical lateral recesses or extensions of the venturi passage. Thus, the thin-walled tubular sheet of water engages the hydro-step to be broken up thereby into fine droplets or a mist.

For a full and more complete understanding of the invention, reference may be had to the following description and accompanying drawings, wherein.

DESCRIPTION OF A PREFERRED EMBODIMENT

Figure 1:
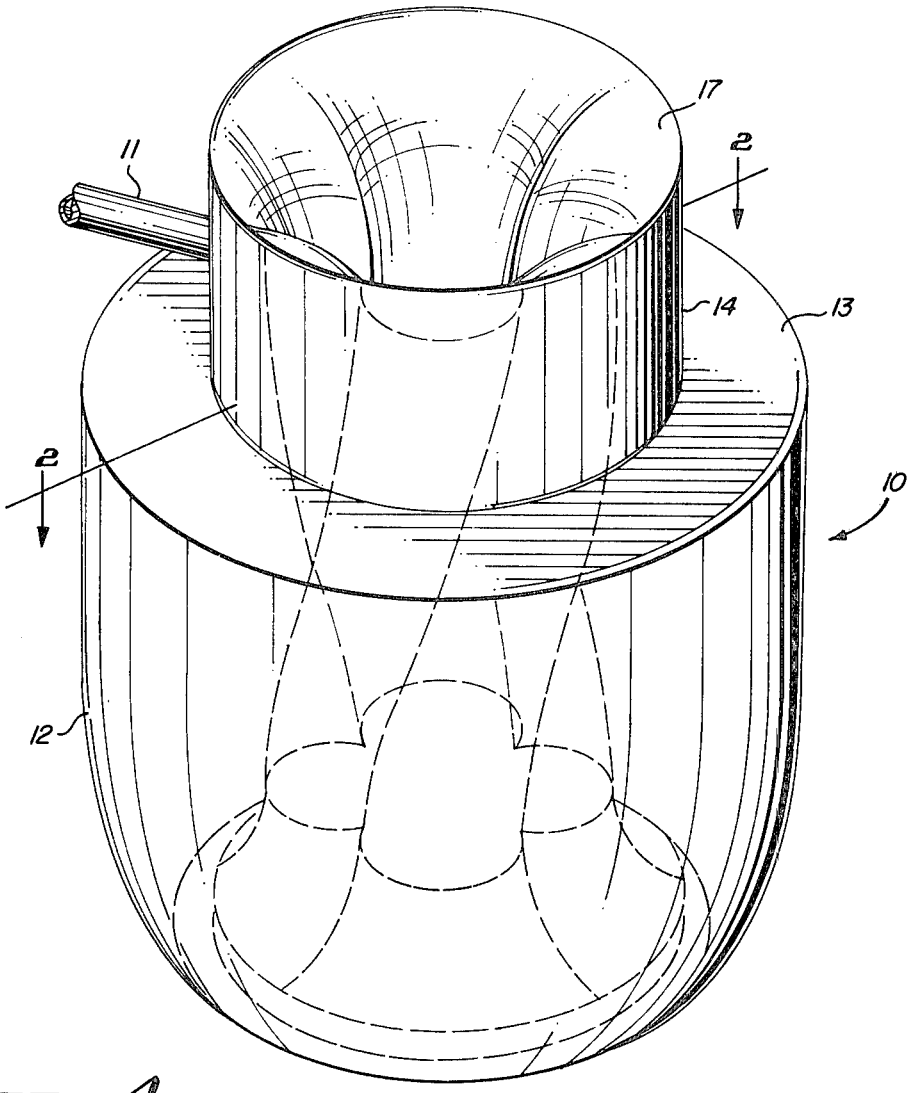
FIG. 1 is a perspective of a spray nozzle embodying the precepts of this invention with the helical lateral extensions or recesses being shown in broken lines.

Referring now to the drawings wherein like reference characters denote corresponding elements throughout the several views, the spray nozzle of this invention is depicted as comprising two main elements. These are a body, referred to in its entirety by the reference character 10, and a conduit for receiving air under pressure, indicated at 11.

Body 10 has a contour defined by a surface 12 which is cylindrical throughout the major portion of its longitudinal extent or height and which terminates at its upper end in a shoulder 13 from which upstands a neck 14. The cylindrical surface 12 merges with a convex surface 15 at the bottom.

A venturi passage, referred to in its entirety by the reference character 16, extends from the upper edge 17 of neck 14 to the lower extremity of convex surface 15. The venturi passage 16 comprises an upper flared portion defined by a convex surface 18, a throat or waist 19, and a lower bell-shaped portion defined by a convex surface 20. For the purposes of this specification, the upper flared portion of the venturi passage is identified by the reference character 18 and the lower bell-shaped portion, by the reference character 20.

Figure 4:
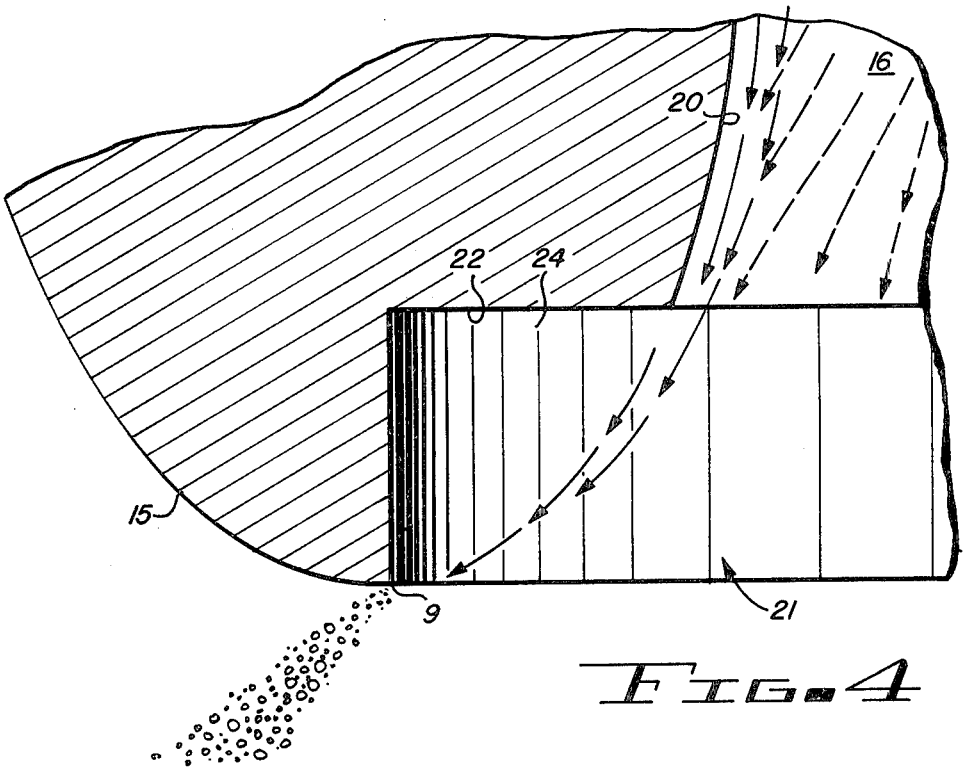
FIG. 4 is a detailed section taken on an enlarged scale at one side of the lower bell-shaped portion of the venturi passage illustrating the hydro-step therein.

Formed at the lower end of bell-shaped portion 20 is a hydro-step designated generally 21. This hydro-step 21 is defined by an annular flat surface 22 which is normal to the axis of the venturi passage 16 and which axis is represented by the line 23. Hydro-step 21 also includes a cylindrical surface 24 which meets the annular surface 22 at the outer periphery of the latter and which is parallel to the axis 23 of venturi passage 16. Cylindrical surface 24 has a lower edge 9 which is sharp and functions to break up the thin-walled tubular sheet of water into fine droplets or a mist as depicted in FIG. 4.

Figure 2:
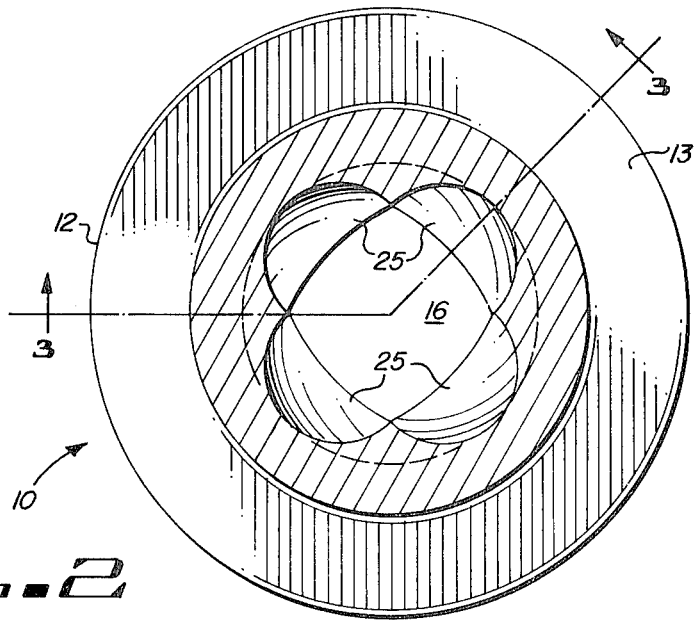
FIG. 2 is a horizontal section through the nozzle, being taken about on the plane represented by the line 2—2 of FIG. 1.

As shown more clearly in FIG. 2, venturi passage 16 is of cloverleaf shape in horizontal cross-section, thus presenting four lateral recesses or extensions 25 which are helical and generally semi-circular in horizontal cross-section. The venturi passages 16, including the semi-circular recesses 25, extend from the top edge 17 of neck 14 to the lower end of convex surface 15.

Figure 3:
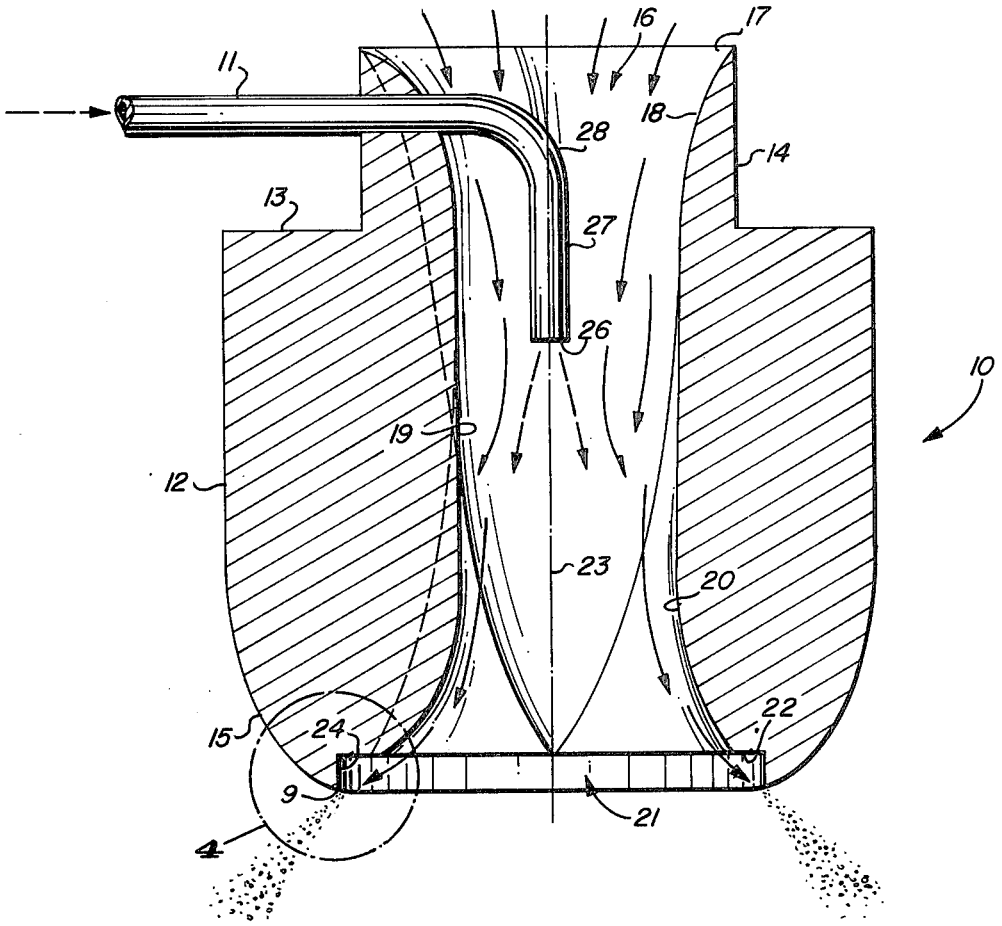
FIG. 3 is a compound vertical section taken about on the planes represented by the lines 3—3 of FIG. 2.

As depicted more clearly in FIG. 3, conduit 11 which receives air under pressure has a discharge end at 26 which is in close proximity to waist 19 but spaced thereabove. That portion of the conduit 11 immediately adjacent to discharge end 26 is designated 27 and is coaxial with the axis 23 of venturi passage 16. Purely by way of example, the conduit portion 27 is illustrated as being joined to the main portion of conduit 11 by a bend 28, with the main body portion of the conduit passing through a tubular passage in neck 14. However, it is to be noted that the portion of conduit 11 that is connected to the portion 27 adjacent to discharge end 26 may enter the upper flared portion 18 at any convenient location.

OPERATION

While the manner of using and operating the subject spray nozzle is believed to be obvious from the illustration of the drawings and description of parts set forth above, they may be briefly described as follows:

A stream of liquid such as water is introduced into the flared upper end 18 of the venturi passage as represented by the arrows in FIG. 3. At the same time, air under pressure passes through conduit 11 and conduit portion 27 adjacent to discharge end 26 and is injected into the stream of water centrally thereof and just above the throat 19. This injection of air under pressure into the stream of water and the passage of the latter through the lateral helical recesses 25 of venturi passage 16 transforms the stream of water into a thin-walled sheet having a swirling motion imparted thereto by the lateral helical recesses 25.

As this thin-walled sheet passas downwardly into the bell-shaped portion 20 at the bottom, it is expanded, speaking diametrically, and engages the edge 9 of cylindrical wall 24 of the hydro-step 21 with the result that it is broken up into a mist or fine droplets. A spray of this type is particularly adapted for use in an electrostatic precipitator but will also find usage in other pieces of equipment requiring water in the form of a mist or fine droplets.

While a preferred specific embodiment of the invention is hereinbefore set forth, it is to be clearly understood that the invention is not to be limited to the exact constructions, mechanisms and devices illustrated and described because various modifications of these details may be provided in putting the invention into practice.

What is claimed is:

1. In a spray nozzle for converting a stream of liquid into a mist or fine droplets:

(a) a body having a venturi passage extending from end to end therein and which passage comprises a flare-shaped portion at one end, an intermediate waist, and a bell-shaped portion at the other end;

(b) a hydro-step formed in said body at said bell-shaped end with said flared end portion being adapted to receive a stream of liquid, said hydro-step having a flat annular surface normal to the axis of the venturi passage and a cylindrical surface parallel to the axis of the venturi passage and meeting said flat annular surface at the periphery thereof;

(c) said venturi passage being cloverleaf in cross-section normal to its axis and having a plurality of lateral helical recesses opening thereinto; and (d) a conduit for delivering air under pressure to said venturi passage and which conduit has a discharge end in close proximity to the waist of the venturi and a portion immediately adjacent to said discharge end and coaxial with said venturi passage.

2. The spray nozzle of claim 1 in which the flared portion of said venturi passage is at the upper end of the latter and the bell-shaped portion at the lower end.

3. The spray nozzle of claim 2 in which said body has a contour the major portion of which is defined by a cylindrical surface terminating in a shoulder at its upper end and a convex surface at its lower end, together with a neck extending upwardly from said shoulder.

4. The spray nozzle of claim 2 in which the venturi passage is cloverleaf in horizontal cross-section, providing a plurality of leaf formations, and the lateral helical recesses correspond in number to the leaves of said cloverleaf formation.

5. The spray nozzle of claim 1 in which the flared portion of the venturi passage is defined by a convex surface and the bell-shaped portion of the venturi passage is defined by another convex surface.

6. The spray nozzle of claim 3 in which said conduit for air under pressure passes through a tubular passage in said neck and assumes a right angle relation with respect to that portion of the conduit adjacent the discharge end and to which it is joined by a bend.

* * * * *